United States Patent [19]

Raasch

[11] Patent Number: 4,711,082

[45] Date of Patent: Dec. 8, 1987

[54] METHOD AND APPARATUS FOR STARTING UP A FRICTION SPINNING ASSEMBLY

[75] Inventor: Hans Raasch, Monchen-Gladbach, Fed. Rep. of Germany

[73] Assignee: W. Schlafhorst & Co., Monchen-Gladbach, Fed. Rep. of Germany

[21] Appl. No.: 919,181

[22] Filed: Oct. 15, 1986

[30] Foreign Application Priority Data

Oct. 16, 1985 [DE] Fed. Rep. of Germany ..... 3536911

[51] Int. Cl.[4] ..... D01H 15/02

[52] U.S. Cl. ..... 57/263; 57/401

[58] Field of Search ..... 57/22, 261, 263, 301, 57/304, 306, 400, 401

[56] References Cited

U.S. PATENT DOCUMENTS

| | | | |
|---|---|---|---|
| 4,132,056 | 1/1979 | Husges et al. | 57/263 |
| 4,223,517 | 9/1980 | Husges et al. | 57/263 X |
| 4,541,233 | 9/1985 | Raasch et al. | 57/263 |
| 4,541,235 | 9/1985 | Raasch | 57/263 |
| 4,598,539 | 7/1986 | Stahlecker et al. | 57/301 X |

*Primary Examiner*—Donald Watkins

*Attorney, Agent, or Firm*—Herbert L. Lerner; Laurence A. Greenberg

[57] ABSTRACT

The method for starting up a friction spinning assembly is used in a friction spinning assembly including: friction surfaces movable in opposite directions forming a spinning wedge, at least one of the friction surfaces being a perforated drum having a suction device with a suction nozzle acting on the spinning wedge by suctioning air through the wall of the at least one perforated drum; at least one suction device acting on the spinning wedge; and an automatic startup device performing a thread joining operation. The method for starting up the friction spinning assembly includes the steps of: inserting a thread for thread joining into the spinning wedge; suctioning air through the at least one perforated drum; and simultaneously feeding fibers to the spinning wedge with a fiber feeding device and moving the friction surfaces at a given normal operating speed, and drawing-off thread from the spinning wedge with a thread drawing-off device simultaneously or after a brief delay at the given normal spinning operation speed. A device is also provided for starting up the friction spinning assembly.

8 Claims, 4 Drawing Figures

METHOD AND APPARATUS FOR STARTING UP A FRICTION SPINNING ASSEMBLY

The invention relates to a method and an apparatus for starting up a friction spinning assembly, including oppositely moving friction surfaces forming a spinning wedge, a fiber feeding device, a thread drawing-off device for drawing-off thread from the spinning wedge, and at least one suction device acting on the spinning wedge. In this method and apparatus, at least one friction surface is in the form of a perforated drum having a suction device with a suction nozzle suctioning air from the spinning wedge through the wall of the perforated drum, especially for correcting a thread break, and an automatic startup device performs a thread joining operation.

The other friction surface can also be in the form of a similar perforated drum. If both perforated drums are driven at the same rotational speed, the friction surfaces move opposite to one another at the spinning wedge. If the second friction surface is also in the form of a perforated drum, the perforated drum also contains a suction device having a suction nozzle that acts upon the spinning wedge through the wall of the perforated drum by aspirating air.

The entire suction device is then divided into two suction arms.

However, the second friction surface may also be formed quite differently: for example, it may take the form of a simple drum or it may be a moving belt.

Friction spinning assemblies of this kind provide an automatic spinning operation. A plurality of friction spinning assemblies can make up a friction spinning machine. The friction spinning assemblies may be provided with either individual drive mechanisms or shared drive mechanisms.

German Published, Non-Prosecuted Application No. DE-OS 33 18 687, corresponding to U.S. Pat. No. 4,541,235, describes the automatic start up of a friction spinning assembly of this kind, especially after a thread break. However, special equipment is necessary to carry out the operations of drawing-in the sliver, separating the fibers, rotating the friction surfaces and drawing-off the thread, in order to initially run at low speeds and subsequently increase to the normal spinning speed.

Aside from the engineering cost, this kind of startup takes more time.

It is accordingly an object of the invention to provide a method and device for starting up a friction spinning assembly, which overcomes the hereinafore-mentioned disadvantages of the heretofore-known devices of this general type, especially for correcting a thread break, to lessen the engineering cost, shorten the startup time and simultaneously make success in starting up the assembly more reliable, so that fewer successive repetitions of the startup process are necessary.

With the foregoing and other objects in view there is provided, in accordance with the invention, in a friction spinning assembly including: friction surfaces movable in opposite directions forming a spinning wedge, at least one of the friction surfaces being a perforated drum with a wall having a suction device with a suction nozzle acting on the spinning wedge by suctioning air through the wall of the at least one perforated drum; at least one suction device acting on the spinning wedge; and an automatic startup device performing a thread joining operation; a method for starting up the friction spinning assembly especially for correcting a thread break, which comprises: inserting a thread for thread joining into the spinning wedge; suctioning air through the at least one perforated drum; and simultaneously feeding fibers to the spinning wedge with a fiber feeding device and moving the friction surfaces at a given normal spinning operation speed; and drawing-off thread from the spinning wedge with a thread drawing-off device at the given normal spinning operation speed simultaneously or after a brief delay.

In accordance with another mode of the invention, there is provided a method which comprises drawing the thread out of the spinning wedge and subsequently delivering the thread to a waste receptacle with the thread drawing-off device.

In accordance with a further mode of the invention, there is provided a method which comprises carrying the continuously drawn-off thread past a thread storage device and past a controllable device for producing a tension or strain-proof thread connection; determining a point in time when the thread is or is assumed with some certainty to be flawless; introducing the thread at the point in time into the thread storage device for temporarily storing the flawless thread; subsequently introducing the beginning of an arriving thread and the end of a thread returned or recovered from a thread collecting point into the device for producing a tension-proof connection; activating the device for producing a tension-proof thread connection; and removing the thread from the thread storage device at increased thread travel speed, introducing the thread into the thread collecting point and subsequently completely transferring the thread back from the vicinity of the startup device to the vicinity of the friction spinning assembly, after the tension-proof connection of the thread has been made.

With the objects of the invention in view there is also provided, in combination with a friction spinning assembly including a thread collecting point collecting thread spun at a normal spinning location, friction surfaces movable in opposite directions forming a spinning wedge, at least one of the friction surfaces being in the form of a peforated drum with a wall, a suction device having a suction nozzle suctioning air from the spinning wedge through the wall of the at least one perforated drum, a fiber feeding device for feeding fibers to the spinning wedge, a thread drawing-off device for drawing off thread from the spinning wedge and at least one suction device acting on the spinning wedge, a device associated with the friction spinning assembly for automatically starting up the friction spinning assembly, the startup device comprising means for delivering the startup device to the friction spinning assembly, a device for inserting a thread in the spinning wedge, a device for producing a tension or strain-proof thread joint or piecing on a piece of thread, a thread storage device, a device for delivering the thread to the thread collecting point after severing the piece of thread having the thread joint and for returning the thread to the friction spinning assembly and into the normal spinning position, and a waste receptacle, the device for producing a tension-proof thread connection being disposed downstream of the thread storage device and upstream of the waste receptacle, as seen in thread travel direction.

In accordance with an added feature of the invention, the thread storage device includes a drivable storage drum, and including means for determining a point in time when the thread is being drawn off flawlessly from the friction spinning assembly to a given degree of certainty, and means for controllably placing the thread against the storage drum at the point in time.

In accordance with a concomitant feature of the invention, there is provided another waste receptacle disposed alongside and upstream of the device for producing a tension-proof thread connection in the thread travel direction, so that one of the waste receptacles is disposed upstream and one of the waste receptacles is disposed downstream of the device for producing a tension-proof thread connection, the first-mentioned downstream waste receptacle receiving a thread arriving from the friction spinning assembly and the other upstream waste receptacle receiving a thread leaving the thread storage device following an unsuccessful thread connection.

The advantages attainable with the invention are in particular that the automatic startup takes place quickly and reliably. Contingencies dependent on manual skill do not arise and unnecessary repeated tripping is avoided during the startup. The engineering expense of providing for different drive speeds of the friction spinning assembly is reduced.

Other features which are considered as characteristic for the invention are set forth in the appended claims.

Although the invention is illustrated and described herein as embodied in a method and device for starting up a friction spinning assembly, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

Figure 1:
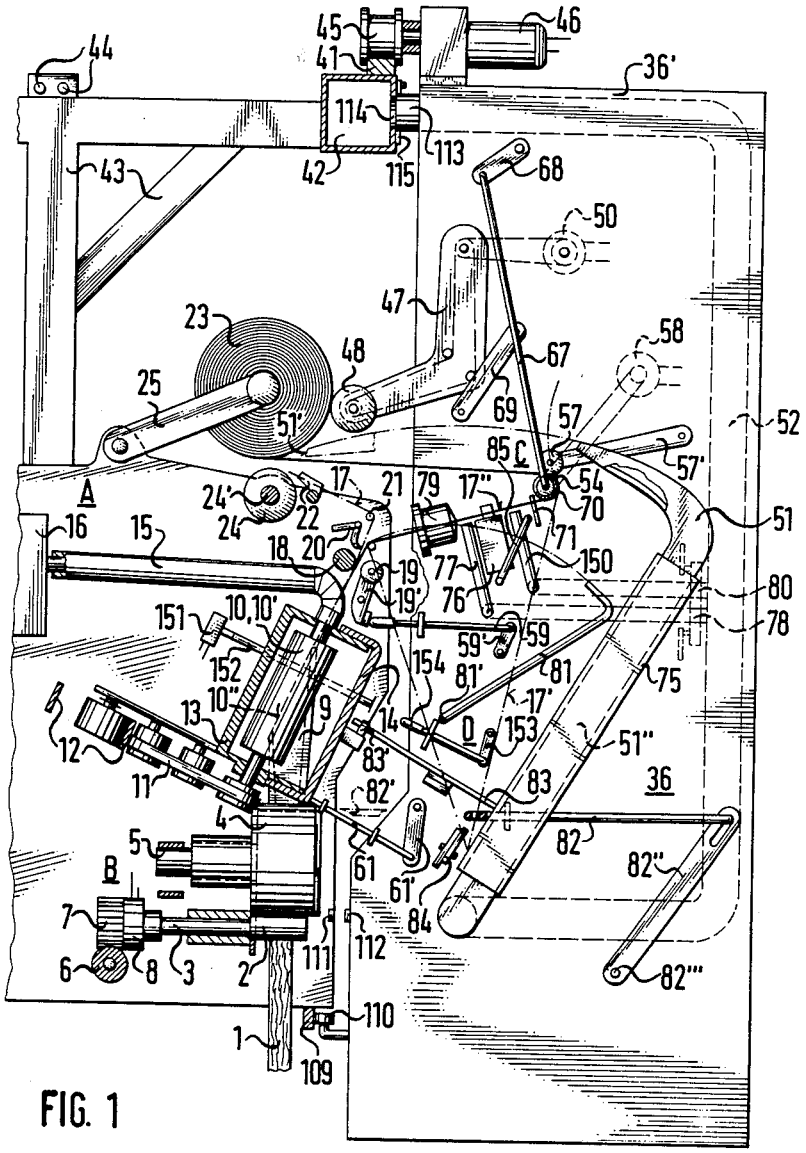
FIG. 1 is a fragmentary, diagrammatic, side-elevational view of a friction spinning assembly.

Referring now to the figures of the drawings in detail and first, particularly, to FIG. 1 thereof, there is seen a friction spinning assembly which is one of a plurality of friction spinning assemblies combined into one friction spinning machine. The individual parts of the friction spinning assembly are kept together substantially by means of a machine frame A. Sliver 1 is fed by a drawing-in or feed roller 2 to an opening or separating roller 4 provided with needles or sawtooth fittings. The opening roller 4 runs at high circumferential speed and separates the sliver 1 into individual fibers.

The drawing-in roller 2 is driven by a worm shaft 6 extending along the friction spinning machine. A worm wheel 7 meshing with the worm shaft 6 is connected through an electromagnetic coupling 8 with a shaft 3 of the drawing-in roller 2.

Figure 2:
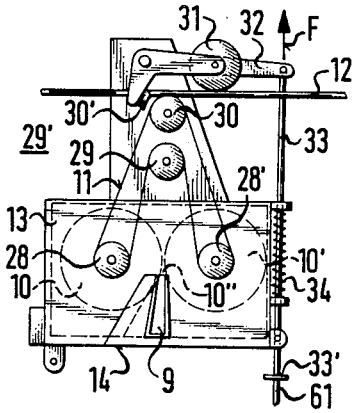
FIG. 2 is a fragmentary, front-elevational view showing details of a drive apparatus for friction surfaces.

The separated or loosened fibers are fed through a fiber channel 9 into a spinning wedge 10″ which is also seen in FIG. 2 and is formed by two perforated drums 10, 10′ located alongside each other. Elements 2-9 together form a fiber feeding device B.

The perforated drums 10, 10′ are driven in the same direction by a belt 11. The belt 11 is driven by a tangential belt 12 that travels along the entire length of the friction spinning machine. The perforated drums 10, 10′ are located in a housing 13 that is closed at the front by a hinged cover 14.

The friction spinning assembly has a suction device that terminates in two suction nozzles, one of which is located inside the perforated drum 10 and the other of which is located inside the perforated drum 10′. The two suction nozzles are almost as long as the spinning wedge 10″. The suction nozzles extend from the inside and terminate so close to the wall of their associated perforated drum, that they aspirate air on the spinning wedge 10″ through the wall of the perforated drum, as soon as a vacuum is produced at the suction nozzles from a channel 16 and a line 15.

The thread formed in the spinning wedge 10″ is drawn off at a constant speed by a thread unwinding or pulling device formed of a draw-off shaft 18, which extends continuously along the entire length of the friction spinning machine and a draw-off roller 19 resting with spring force against the draw-off shaft 18. The thread travels past a thread monitor 20. The thread monitor 20 is capable of performing several control functions. If the thread breaks, for instance, it acts upon the electromagnetic coupling 8 that serves as a shutoff device for the thread feeding operation and brings the drawing-in roller 2 to a standstill. If a thread breaks it can also act on a non-illustrated device which raises a bobbin frame or creel 25 of a feeding bobbin or delivery spool or creel bobbin 23 serving as a thread collecting point, so that the bobbin loses contact with a lap or winding roller 24. The thread monitor 20 can also perform other reporting and control functions. For instance, it also emits a signal that causes a startup device 36 traveling past it to correct a thread break.

The thread travels behind the thread monitor 20, over a wire 21 for compensating for diagonal pulling or tension, then passes through a reciprocating thread guide 22 and is wound onto the feeding bobbin 23 forming a cross-wound bobbin or cheese. To this end, the bobbin 23 rolls on the rotating lap roller 24, the shaft 24′ of which is guided along the entire friction spinning machine.

The automatic startup device 36 which is also shown in FIG. 1, is movable and services all of the friction spinning assemblies of the friction spinning machine in chronological succession. The apparatus 36 is movable on a rail 41, which is secured on a suction channel 42, by means of traveling rollers 45. The suction channel 42 enables the startup device 36 to be connected to a suction air source, regardless of where it is located. The suction channel 42 is supported with respect to the machine frame A by means of a supporting structure 43. Energy supply lines 44 which, for instance, deliver electrical energy and optionally compressed air to the startup device 36, are located in hollow spaces in the supporting structure 43. One of the two traveling rollers 45, which are located one behind the other, is driven by a traveling mechanism motor 46.

The startup device 36 has a device 47 for driving the feeding bobbin 23 both in the thread winding direction and opposite thereto. The device 47 is in the form of a pivotable bobbin driving arm, which is provided with a drive roller 48 that is in operative connection with a bobbin driving motor 50.

As soon as the drive roller 48 has come into contact with the feeding bobbin 23, it is driven by friction either in the thread winding direction or opposite thereto, depending on the direction of rotation of the bobbin driving motor 50.

The startup device 36 also has a thread returning or recovery device 51, in the form of a pivotable suction nozzle, which is movable as far as the thread collecting point, which in this case is the feeding bobbin 23, and back again. The thread returning device 51 communicates through a line 52 with the suction channel 42. A mechanism located in the housing 36' of the startup device 36 is capable of pivoting the thread returning device 51 toward the feeding bobbin spool 23 and back again. As soon as the drive roller 48 rotates the feeding bobbin 23 against the thread winding direction, the thread returning device 51 pivots forward as far as a position 51' thereof and exerts suction upon the surface of the bobbin. The purpose of this procedure is to locate the end of the thread and aspirate it. Once a predetermined aspiration period has elapsed, the thread returning device 51 pivots back into the position shown in FIG. 1.

The suction nozzle 51 has a longitudinal slit on the inside thereof. The thread can emerge from the slit, once the suction nozzle has pivoted back again, as soon as a suction nozzle cover 75, in the form of a collar that can be rotated around a lower tubular portion 51'' of the suction nozzle 51, uncovers the slit. In this manner the aspirated thread is provided with a position that facilitates later placement of the thread into the spinning wedge.

As soon as the thread has been aspirated, a thread drawing-off device generally identified by reference numeral C is activated for the thread joining operation. A stationary drawing-off roller 54, which cooperates with a drawing-off roller 57 supported on a pivotable arm 57', is part of the device C.

The elements 57 and 57' form a control device for drawingoff the thread during the thread joining operation.

When the thread 17' emerges from the slit of the suction nozzle 51, it wraps itself around the drawing-off roller 54. The drawing-off roller 57 presses the thread 17' against the drawing-off roller 54, after the arm 57' has pivoted. The drawing-off roller 54 is operatively connected to a drawing-off motor 58.

A program-controlled device, generally identified by reference numeral D, operates for inserting the thread 17' into the spinning wedge 10''. The device D has an upper and a lower inserter. The upper inserter 81 is formed of a lever pivotable about a pivot point 81', and the lower inserter 82 is formed of a rod that is horizontally displaceable as far as a position 82' and can be actuated by a pivot lever 82''. The pivot lever 82'' is pivotable about a pivot point 82''' as programmed by means of a mechanism located in the housing 36'.

The upper inserter 81 and the lower inserter 82 press the thread 17' into the spinning wedge 10'. For this purpose, the cover 14 must be opened. This is done by a box opener 83, which engages a lock 83' of the cover 14 and swings it open.

The startup device 36 also has a device 59 for turning the thread draw-off device 18, 19 of the friction spinning assembly off and on again. The device 59 is in the form of a push rod or tappet, which can be pressed by means of a lever 59' against a lever 19', which supports the draw-off roller 19. In so doing, the draw-off roller 19 is raised from the draw-off shaft 18, so that the thread draw-off device of the friction spinning assembly becomes inoperative.

As soon as the draw-off roller 19 of the friction spinning assembly has been raised from the draw-off shaft 18 by the device 59, the thread 17' can be inserted by the upper inserter 81 behind the draw-off roller 19. The thread that has been inserted into the spinning wedge 10'' is cut off at the base of the suction nozzle 51 by a thread cutting device 84.

The startup device 36 also has a device 61 for starting up the movable parts of the friction spinning assembly that form the friction surfaces, in this case the two perforated drums 10, 10'. The device 61 is in the form of a push rod or tappet which, as particularly shown in FIG. 2, can be pressed against a plate 33' of a rod 33, that is pivotably secured to a pivotable lever 32. The lever 32 carries a pressing roller 31, which is raised from the tangential belt 12 so that the tangential belt 12 loses its contact with the back of the belt 11. At the same time, a brake shoe 30' next to the belt 11 is applied to a roller 30, which will be referred to again below, and thereby brakes the drive for the perforated drums. This may have already been done by the thread monitor 20, which actuates a device F for stopping the movable friction elements; the device F is indicated in FIG. 2 by an arrow. In any case, when the startup device 36 is activated, the push rod 61 is pushed forward and cancels the action of the thread monitor 20. If the perforated drums are to begin to operate later, the push rod 61 is retracted again by means of the lever 61'. In any case, this occurs after the startup program, which will be described below.

FIG. 1 also shows that a support rail 109 formed of individual pieces of rail runs along the friction spinning machine and support rollers 110 of the startup device are supported on the support rail 109.

A signal transmitter 111 that is operatively connected to the thread monitor 20 and acts upon a signal receiver 112 of the startup device 36 is provided on the friction spinning assembly, in order for the startup device 36 to stop at a particular friction spinning assembly so that it can correct a thread break at the spinning assembly. The signal receiver 112 then causes the startup device 36 to stop and brings about the start of the fixed startup program which will be described below.

When the startup device moves into its working position, a coupling element 113 located at the end of the line 52 laterally pushes a flap 115, which is pivotably supported in front of an opening 114 of the suction channel 42 and therefore provides communication between the suction nozzle 51 and the suction channel 42.

The two perforated drums 10, 10' should rotate as synchronously as possible, in particular whenever the perforated drums start up during automatic thread spinning or when the friction spinning assembly is started up. However, it may also be desirable for one perforated drum to rotate at a faster speed than the other, so as to vary the retention of the thread in the wedge region. In that case the difference in rotational speed is quite small, but must also be adhered to precisely. This is assured by a drive device 29', shown particularly in FIG. 2, for driving the perforated drums 10, 10'. FIG. 2 shows that wharves or whorls 28, 28' are encompassed by the belt 11 over an angle of approximately 180°, which assures good slaving of the wharves. The belt 11 travels over rollers 29 and 30, the roller 29 being adjustable and serving as the tensioning roller. The roller 30 which is supported in a stationary manner serves as the driving roller. The tangential belt 12 which is guided along the entire friction spinning machine is pressed by the pressing roller 31 against the back of the belt 11.

The coupling 8 is turned on and off by a switch 151, which is connected by electric leads to the electromagnetic coupling 8. The switch 151 can be turned on and off by means of an actuating rod 152. A push rod or tappet 154 supported on the housing 36' of the startup device 36 is capable of actuating the actuating rod 152 by means of a switch lever 153.

A thread storage device 79 is disposed on the startup device 36 somewhat above the level of the thread draw-off device 18, 19. Downstream of the thread storage device 79 is a device 76 for producing a tension or strain-proof thread connection. The device 76 is followed by a waste receptacle 150. A further waste receptacle 77 is located next to the device 76 for producing a tension or strain-proof thread connection and downstream thereof, in the direction of thread travel, so that respective waste receptacles 150 and 77 are located both upstream and downstream of the device 76; the waste receptacle 150 located upstream receives the thread arriving from the friction spinning assembly, and the waste receptacle 77 located downstream receives the thread running out of the thread storage device 79 after an unsuccessful thread connection.

The startup device 36 also has a device 67 for returning the joined thread to the thread collecting point 23 and for returning the thread to the friction spinning assembly and to the normal spinning position. The device 67 is formed of a rod that is pivotably suspended from two pivotably supported levers 68 and 69. The device 67 has a transfer roller 70. Due to the special suspension of the device 67, the transfer roller 70 is guided in such a way that the loop of a thread 17'' that forms between the delivery bobbin 23 and the friction spinning assembly after it has been joined is shifted from the drawing-off roller 54 onto the transfer roller 70 and is then guided in such a way that the thread is inserted downstream of the draw-off roller 19 and into the thread guide 22 of the friction spinning assembly.

The thread storage device 79, which in principle is constructed as described in co-pending U.S. application Ser. No. 860,677, filed May 7, 1986, is shown in particular in FIGS. 3 and 4.

A thread guide 201 of the thread storage device 79 which is constructed as a rotationally symmetrical body, is supported on supporting means in the form of support roller configurations *2a, 2b* and *2c* which are distributed about the periphery. The support roller configuration each include four support rollers 226 and 227, which are rotatably supported in a machine frame 203.

Figure 4:
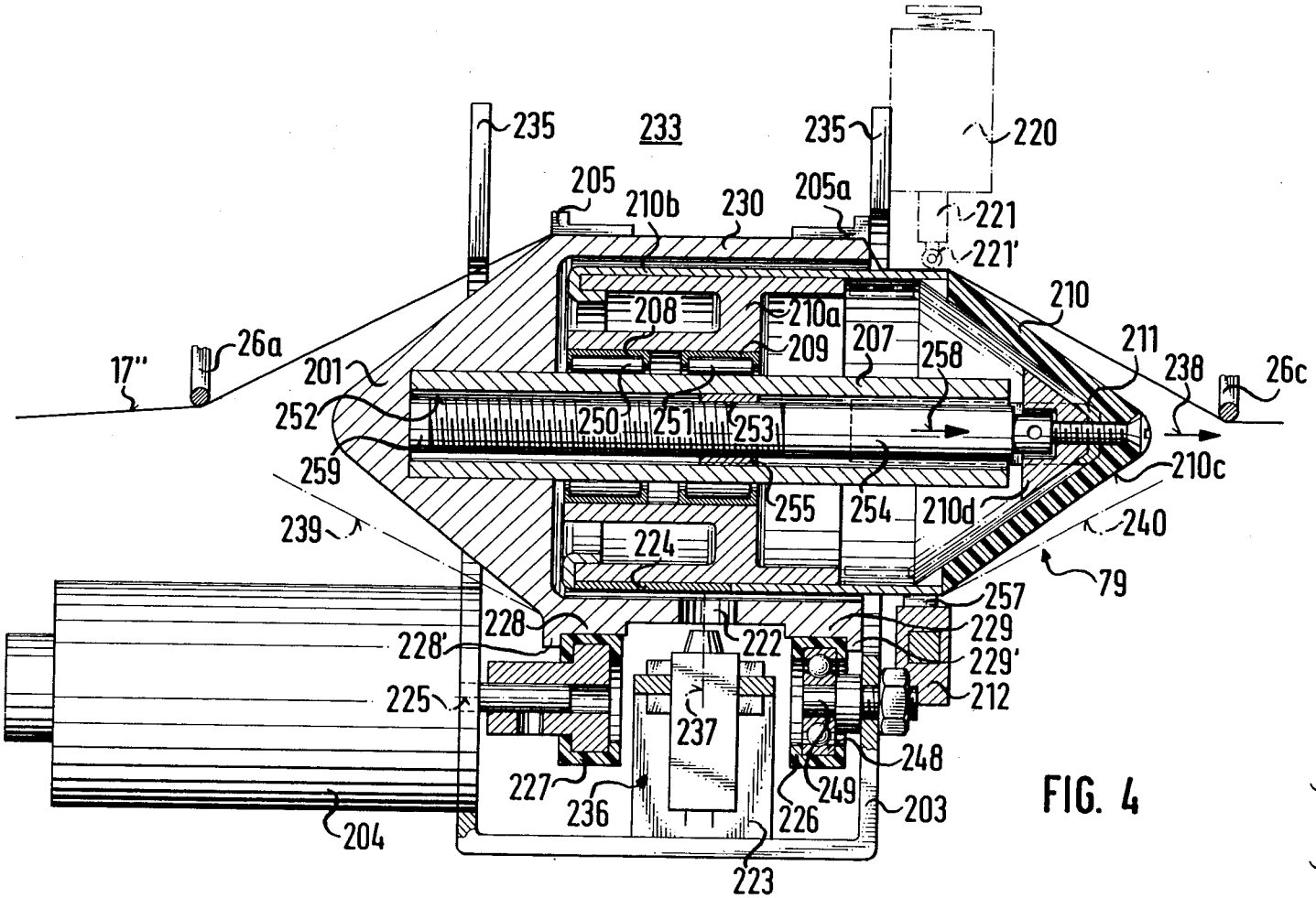
FIG. 4 is a cross-sectional view of the thread storage device taken along the line IV—IV of FIG. 3, in the direction of the arrows.

According to FIG. 4, each support roller 226 is supported by means of a roller bearing 248 on a shaft 249 secured to the machine frame 203.

A pivot shaft 225 of the support roller 227 that is shown in FIG. 4 is connected to a drive motor 204. With the drive motor 204 running, the support roller 227 drives the thread guide 201 by frictionally engaging a tube-like end section 230 thereof which partly fits over a storage drum 210. The storage drum 210 is substantially formed of a core 210*a*, a jacket 210*b*, a head 210*c* and an insert 210*d*.

A hollow central shaft 207 is screwed to the body 201. The shaft 207 has bearings 208, 209 for the storage drum 210. Rollers 250, 251 of the bearings, constructed as roller bearings, are capable of rolling on the shaft 207 and are supported in such a way that they are longitudinally displacable. The shaft 207 also has a displacement device, including an element 254 which is connected to the storage drum 210 and has an axially symmetrical thread 252, and an element 255 connected to the thread guide 201, the element 255 being provided with an axially symmetrical thread 253 which fits and meshes with the thread 252 of the first element 254. The element 254 of the storage drum 210 includes a threaded rod which meshes with the female thread 253 of the second element 255, which is in the form of an inserted threaded tube and is a component of the hollow shaft 207 of the thread guide 201.

The element or threaded rod 254 is screwed to the storage drum 210.

The support rollers 226, 227 roll on runner rings or treads 228, 229 of the tube-like end section 230 of the body 201. The runner rings 228, 229 are provided with radially open thread guide slits 205, 205*a*. For better guidance of the support rollers, the runner rings 228, 229 have flange rings 228', 229'.

Figure 3:
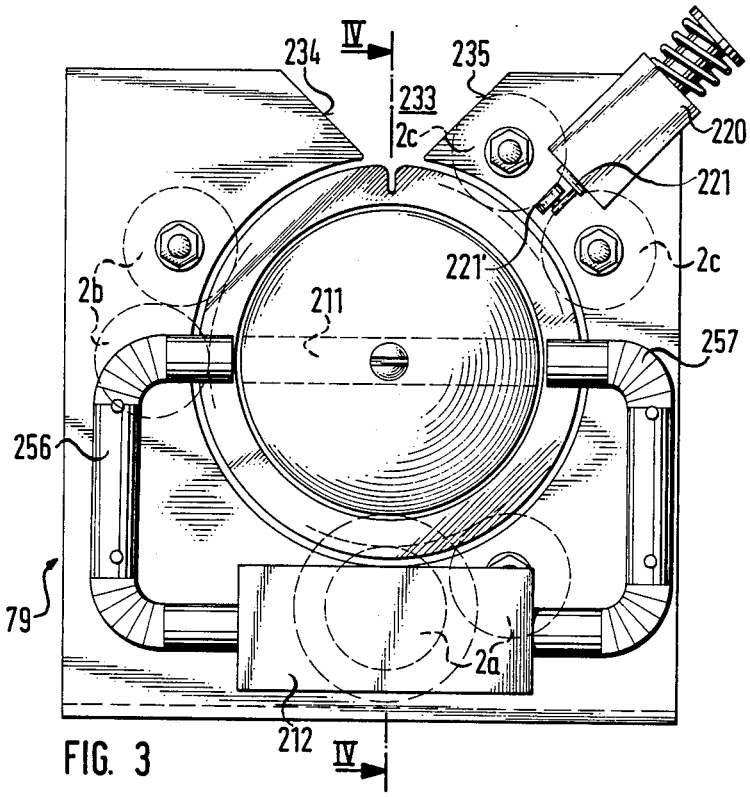
FIG. 3 is an enlarged, front-elevational view of a thread storage device.

The stabilized location of the storage drum 210 is assured by means of magnetic forces, which act between an element 212 disposed in a stabilized manner on the machine frame 203 and an element 211 disposed on the storage drum 210. The element 212 disposed in a stabilized manner on the machine frame 203 is in the form of an electromagnet, having poles 256, 257 which are offset by 180° from one another, which face one another, and are spaced apart with respect to the storage drum 210, as shown in FIG. 3. The element 211 disposed on the storage drum 210 is constructed in the form of a strip of soft iron which extends from a point opposite one pole 256 of the first element 212 up to a point opposite the other pole 257 of the first element 212.

As shown in FIGS. 3 and 4, a switchable or indexable thread holding device 220 is connected to the machine frame 203. This device includes an electromagnet drive mechanism, having a push rod or tappet 221 which is provided with a roller 221' and can be moved forward as far as the surface of the storage drum 210 when the electromagnetic drive mechanism is switched on. In FIG. 4, the thread holding device 220 is shown in phantom because it is actually located at a much lower location in the sectional illustration.

The electromagnetic drive mechanism 220 is electrically connected in parallel to the electromagnet of the element 212 which assures the stabilized location of the storage drum 210.

A special threading and unthreading position 233 is provided on the machine frame 203. This position has thread guide contours 234 and 235. The thread guide contours are spread apart in funnel-like fashion, widening toward the outside, and they guide a thread 17'' into the thread guide slits 205, 205*a* if the thread guide 201 is in its zero or off position. This is always the case whenever the thread guide slits 205, 205*a* are located at the threading position 233. Otherwise the thread 17'' is first caused to rest against the flange rings 228', 229' by the thread guide contours 234, 235 and only then, because of the rotation of the body 201, is the thread automatically introduced into the thread guide slits 205, 205*a*.

In order to adjust the thread guide 201 into its zero position, a zero setting device generally identified by reference numeral 236 in FIG. 4 is provided. The zero setting device 236 has a sensor 223 that controls the drive motor 204 of the support roller 227. The sensor 223 responds to a marking 222 of a particular kind which is provided on the thread guide 201.

Since the sensor 223 is in the form of a reflecting light barrier or electric eye in the illustrated embodiment, the marking 222 mentioned above is in the form of an opening in the tube-like end section 230 of the thread guide 201. The optical axis 237 of the reflecting light barrier 223 is aimed through the opening 222 at a reflector strip 224 secured to the storage drum 210.

The reflecting light barrier 223 has a non-illustrated operative connection with the drive motor 204. In response to a control command to establish the zero position, the reflecting light barrier 223 acts upon the drive motor 204 by means of control signals which bring about forward travel, or alternating forward travel and reverse travel, until such time as the optical axis 237 strikes the reflector strip 224. The thread guide slit 205 is in the zero position in front of the threading position 233, as shown in FIGS. 3 and 4.

FIG. 4 shows the storage drum 210 in the inserted state. If it is held firmly by magnetic forces while the thread guide 201 rotates, then its threaded rod 254 unscrews out of the female thread 253 in the direction of the arrow 258. If the pitch of the screw thread is equal to or greater than the thickness of the thread being spun, the windings are placed alongside each other on the storage drum 210.

A storage operation will now be described in greater detail, referring to FIG. 4.

The thread 17″ delivered by the thread inserters **26*a*, 26*c* first travels through the thread storage device 79, without being stored there. With the thread guide 201 at rest, first the thread holding device 220 is actuated for preparing for storage, so that the push rod 221, which has the roller 221′ on one end thereof, is moved forward as far as the surface of the storage drum 210, as shown in FIG. 4. At the same time the electromagnet 212 is switched on. The thread 17″ has previously passed through the threading position 233 and entered the thread guide slits 205, 205*a*. The drive motor 204 then sets the thread guide 201 into operation. The thread is capable of extending as far as the push rod 221 without winding about the storage drum. The thread is stopped at the push rod 221** and the thread begins to wind up on the storage drum no later than this point in time.

The thread 17″ is then continuously carried along through the thread guide slits **205, 205*a* and thereby forms a thread balloon 239 on a feeding or entry side. During the storage process, the storage drum 210 moves in the direction of the arrow 258 out of the tube-like end section 230 of the thread guide 201. Once the desired number of windings, or a maximum possible number of windings has been stored, the drive motor 204 is shut off. At the same time the thread holding device 220 and the electromagnet 212 are switched off. The thread 17″ is drawn off over the head or end of the storage drum 210, through the thread guide element 219, in the drawing-off direction 238, forming a thread balloon 240 on the outlet side. Once the thread storage device has been emptied, the drive motor 204 is switched to reverse operation and switched on again until such time as the threaded rod 254 has screwed back into its basic position shown in FIG. 4**.

If the drive motor should coincidentally travel too far in the forward direction, a collar 259 provided on the end of the threaded rod 254 prevents the threaded rod from rotating all the way out of the female thread 253.

If the thread 17″ is to be withdrawn from the thread storage device once again, after all of the stored windings have been used up all that needs to be done is to put the thread guide 201 initially into its zero position and then to optionally pivot the thread inserters **26*a*, 26*c*** back into position if they are present.

Since FIG. 4 shows the thread storage device 79 rotated through 45°, the thread inserters **26*a*, 26*c*, if they are present at all, in actuality do not operate above, but rather in front of, the thread storage device 79**.

After thread piecing, the thread enters the waste receptacle 150, which takes the form of a suction device; during this time the bobbin driving motor 50 is switched off and accordingly no further length of thread is drawn off from the bobbin 23.

Once the pieced portion has entered the waste receptacle 150 and once it has been determined that the thread which is being continuously produced is satisfactory, an inserter 85 pivots away beyond the device 76 for producing a tension-proof connection while carrying the thread along with it, and inserts the thread into the device 76. In so doing it inserts the loop of thread in such a way that the piece of thread arriving from the bobbin 23 is inserted into the device 76, but the piece of thread extending to the suction device or receptacle 77 is placed alongside the device 76.

During the period in which the device 76 produces the thread connection while cutting out the joined portion, the thread that continues to be supplied by the draw-off device 18, 19 is received by the thread storage device. To this end, making reference to FIG. 4, the drive motor 204 is switched on, so that the storage operation continues in the above-described manner until such time as the thread connection has been produced and the stored length of thread has again been used up.

As soon as the thread connection has been produced, the bobbin 23 is driven in the winding direction by the drive roller 48, so that the resupplied thread and the piece of thread that is still located on the storage drum 210 are wound up.

The suction flow for the waste receptacle 77, which has thus far not been operative, is controlled by a valve 78 and the suction flow for the waste receptacle 150 is controlled by a valve 80.

After the thread has been connected, the loop of thread that extends from the bobbin 23 to the drawing-off roller 54 and from there to the spinning wedge 10″ must be returned to the friction spinning assemble. Therefore, after the drawing-off roller 57 is raised, a thrower 71 throws the loop of thread onto the transfer roller 70 of the device 67. Since the bobbin 23 is initially driven significantly faster than that which would correspond to the supply of thread on the part of the friction spinning assembly, the thread storage device 79 empties and its thread guide 201 is then moved into the unthreading position and stopped. Then the device 67 pivots in the direction of the compensating wire 21. Once it has reached its forwardmost position, the bobbin driving arm 47 releases the bobbin 23, so that it drops back onto the lap roller 24. As a result, the thread can be threaded into the thread guide 22. In so doing, the thread is drawn off the transfer roller 70. If the thread connection should be unsuccessful, the valve 78 is opened, so that the waste receptacle 77 grasps the thread and draws it out of the yarn storage device 79.

The entire thread joining and connecting operation takes place according to the following pattern:

Once the startup device 36 reaches a friction spinning assembly at which the thread monitor or sensor 20 is signalling a thread break, the signal transmitter 111 sends a thread break signal to the signal receiver 112 of the startup device 36. The thread joining program therefore begins and at the beginning of the program the traveling mechanism motor 46 is switched off. This is the prerequisite for the startup device 36 to move into the thread joining position. At the same instant, the device 47 is started, which presses the drive roller 48 against the feeding bobbin 23. At the same instant, the thread returning device or nozzle 51 is also started and the suction nozzle mouth thereof moves into the vicinity of the surface of the bobbin 23. The bobbin driving motor 50 moves backward at the thread locating speed. After a brief period, it is shut off again.

As soon as the suction nozzle cover 75 begins to close the slit in the thread returning device 51, the device 61 is started as well, so as to disengage the drive device 29' from the tangential belt 12.

The end of the thread that has been taken up onto the bobbin 23 is then aspirated by the thread returning device 51. The the device 59 is then actuated, so as to raise the draw-off roller 19 from the draw-off shaft 18.

In the meantime, a piece of thread of sufficient length has been aspirated into the suction nozzle or thread returning device 51. The suction nozzle 51 is then pivoted back into its initial position. At the same time, the box opener 83 is also actuated, in order to open the cover 14 so that the thread can be inserted into the spinning wedge 10''. At the same instant, the suction nozzle cover 75 is rotated back into its initial position, in order to re-open the longitudinal slit in the suction nozzle 51, which is aimed at the friction spinning assembly. During this process, the aspirated thread slips out of the longitudinal slit while the suction nozzle 51 is pivoting.

The upper inserter 81 is then actuated. Somewhat later, the lower inserter 82 is actuated as well. Both inserters grasp the thread 17' and insert it into the spinning wedge 10''.

Up to this point, lengths of thread continue to be returned from the feeding bobbin 23 and aspirated. The bobbin driving motor 50 is stopped and the drawing-off of thread from the feeding bobbin is brought to a standstill only when the lower inserter 82 has reached its final position. At the same instant, the box opener 83 recloses the cover 14. When slipping out of the longitudinal slit of the suction nozzle 51, the thread becomes wrapped around the drawing-off roller 54.

As soon as the drawing-off roller 57 is pressed against the drawing-off roller 54 due to the pivoting motion of the arm 57', the thread is clamped in place between the drawing-off rollers 54 and 57. The scissors 84 are actuated even before the drawing-off roller 57 has been pressed against the drawing-off roller 54, so as to cut the thread 17' at the point at which it leaves the suction nozzle 51 below the longitudinal slit cover 75. The two inserters 81, 82 are then retracted again. At the same instant, after actuation of the push rod 154, the delivery of sliver is started. The flow of fibers to the spinning wedge is thereby initiated.

The suction receptacle 150 is then subjected to negative pressure or vacuum by opening the valve 80. At the same time, the push rod 61 is actuated and the perforated drums begin to rotate. The draw-off device 18, 19 is also switched over at this moment to drawing off thread, as a result of the contact of the draw-off roller 19. Since the feeding or creel bobbin 23 is still stopped, the thread 17'' drawn out of the spinning wedge 10'' is received by the waste receptacle 150 and suctioned away.

The thread 17'' is suctioned away until such time as the joined location, which forms a bead or slub in the thread, has been sucked into the suction receptacle 150. The motors 50 and 58 and shifted into reverse, so that the feeding bobbin 23 will again release a certain length of thread. This length of thread is moved past the device 76 by the now-started inserter 85. In this process, the piece of thread arriving from the take-up spool is inserted into the device 76, and the thread also continues to be sucked into the waste receptacle 150 and kept under tension. The device 76 is then started as well, in order to connect the piece of thread arriving from the bobbin 23 with the piece of thread arriving from the spinning wedge 10'', in the course of which the thread joining location is cleaned. At the same time, after actuation of the thread inserters **26*a*, 26*c*, the thread 17'' is presented to the thread storage device 79 where it is stored temporarily after the drive motor 204** is turned on, until the thread connection has been made.

Once the thread connection has been made, the motors 50 and 58 are shifted to forward operation, so that the feeding or delivery bobbin 23 is caused to run at a speed above the operating speed, the thread is transported accordingly and the stored length of thread is be used up. The drawing-off roller 57 is raised from the drawing-off roller 54. At the same time, the thrower 71 is also actuated, which thereupon throws the thread loop off the drawing-off roller 54 and places it onto the transfer roller 70 of the device 67. The thread guide 201 of the thread storage device 79 is moved into the unthreading position and stopped no later than this point in time, so as to enable the thread to leave the thread storage device 79 once again. The device 67 then pivots toward the wire 21 which compensates for diagonal tension. At that location, the thread slides laterally off the transfer roller 70 and is threaded into the thread guide 22. The device 67 then pivots back again.

The valve 80 is closed again. As soon as the excess length of thread has been used and wound onto the bobbin 23, the spool drive motor 50 is first shifted to normal winding speed and then turned off. At the same instant, the device 47 is pivoted back into its initial position. The thread monitor 20 then assumes its monitoring function and if necessary also unlocks the bobbin frame 25, so that the feeding bobbin 23 is no longer prevented from pressing against the rotating lap roller 24. This may already occur at the time when the device 67 is pivoted back. The inserter 85 is pivoted back into its initial position.

The drawing-off roller 54 previously required for transporting the thread is put out of operation by shutting off of the drawing-off motor 58. Finally, the continued travel of the startup device 36 can begin by turning on the traveling mechanism motor 46.

The invention is not limited to the embodiment shown and described herein. For example, the scissors 84 could be dispensed with in the case of thin threads, because once the perforated drums start to move, the desired thread breakage takes place automatically due to the unwinding of the thread. The thread connecting device may have means for shortening the thread ends.

Alternatively, the thread storage device may advantageously be constructed in accordance with co-pending U.S. application Ser. No. 860,676, filed May 7, 1986. In a thread storage device of this kind, the stored layers of thread are pushed forward on the storage drum by means of a wobble plate.

The foregoing is a description corresponding in substance to German Application P No. 35 36 911.6, dated Oct. 16, 1985, the International priority of which is being claimed for the instant application, and which is hereby made part of this application. Any material discrepancies between the foregoing specification and the aforementioned corresponding German application are to be resolved in favor of the latter.

I claim:

1. In a friction spinning assembly including: friction surfaces movable in opposite directions forming a spinning wedge, at least one of the friction surfaces being a perforated drum having a suction device with a suction nozzle acting on the spinning wedge by suctioning air through the wall of the at least one perforated drum; at least one suction device acting on the spinning wedge; and an automatic startup device performing a thread joining operation; a method for starting up the friction spinning assembly, which comprises: inserting a thread for thread joining into the spinning wedge; suctioning air through the at least one perforated drum; and simultaneously feeding fibers to the spinning wedge with a fiber feeding device, moving the friction surfaces and drawing-off thread from the spinning wedge with a thread drawing-off device, at a given normal spinning operation speed.

2. In a friction spinning assembly including: friction surfaces movable in opposite directions forming a spinning wedge, at least one of the friction surfaces being a perforated drum having a suction device with a suction nozzle acting on the spinning wedge by suctioning air through the wall of the at least one perforated drum; at least one suction device acting on the spinning wedge; and an automatic startup device performing a thread joining operation; a method for starting up the friction spinning assembly, which comprises: inserting a thread for thread joining into the spinning wedge; suctioning air through the at least one perforated drum; and simultaneously feeding fibers to the spinning wedge with a fiber feeding device and moving the friction surfaces at a given normal spinning operation speed; and drawing-off thread from the spinning wedge with a thread drawing-off device at the given normal spinning operation speed after a brief delay.

3. Method according to claim 1, which comprises drawing the thread out of the spinning wedge and subsequently delivering the thread to a waste receptacle with the thread drawing-off device.

4. Method according to claim 1, which comprises carrying the continuously drawn-off thread past a thread storage device and past a controllable device for producing a tension-proof thread connection; determining a point in time when the thread is flawless; introducing the thread at the point in time into the thread storage device for temporarily storing the flawless thread; subsequently introducing the beginning of an arriving thread and the end of a thread returned from a thread collecting point into the device for producing a tension-proof connection; activating the device for producing a tension-proof thread connection; and removing the thread from the thread storage device at increased thread travel speed, introducing the thread into the thread collecting point and subsequently completely transferring the thread back from the vicinity of the startup device to the vicinity of the friction spinning assembly, after the tension-proof connection of the thread has been made.

5. Method according to claim 1, which comprises carrying the continuously drawn-off thread past a thread storage device and past a controllable device for producing a tension-proof thread connection; determining a point in time when the thread is assumed to be flawless; introducing the thread at the point in time into the thread storage device for temporarily storing the flawless thread; subsequently introducing the beginning of an arriving thread and the end of a thread returned from a thread collecting point into the device for producing a tension-proof connection; activating the device for producing a tension-proof thread connection; and removing the thread from the thread storage device at increased thread travel speed, introducing the thread into the thread collecting point and subsequently completely transferring the thread back from the vicinity of the startup device to the vicinity of the friction spinning assembly, after the tension-proof connection of the thread has been made.

6. In combination with a friction spinning assembly including a thread collecting point collecting thread spun at a normal spinning location, friction surfaces movable in opposite directions forming a spinning wedge, at least one of the friction surfaces being in the form of a peforated drum with a wall, a suction device having a suction nozzle suctioning air from the spinning wedge through the wall of the at least one perforated drum, a fiber feeding device for feeding fibers to the spinning wedge, a thread drawing-off device for drawing off thread from the spinning wedge and at least one suction device acting on the spinning wedge, a device for automatically starting up the friction spinning assembly, said startup device comprising means for delivering said startup device to the friction spinning assembly, a device for inserting a thread in the spinning wedge, a device for producing a tension-proof thread joint on a piece of thread, a thread storage device, a device for delivering the thread to the thread collecting point after severing the piece of thread having the thread joint and for returning the thread to the friction spinning assembly and into the normal spinning position, and a waste receptacle, said device for producing a tension-proof thread connection being disposed downstream of said thread storage device and upstream of said waste receptacle, as seen in thread travel direction.

7. Device according to claim 6, wherein said thread storage device includes a drivable storage drum, and including means for determining a point in time when the thread is being drawn off flawlessly from the friction spinning assembly to a given degree of certainty, and means for controllably placing the thread against the storage drum at the point in time.

8. Device according to claim 6, including another waste receptacle disposed alongside and upstream of said device for producing a tension-proof thread connection in said thread travel direction, so that one of said waste receptacles is disposed upstream and one of said waste receptacles is disposed downstream of said device for producing a tension-proof thread connection, said first-mentioned downstream waste receptacle receiving a thread arriving from the friction spinning assembly and said other upstream waste receptacle receiving a thread leaving said thread storage device following an unsuccessful thread connection.

* * * * *